US006899318B2

(12) United States Patent
Bertoja

(10) Patent No.: US 6,899,318 B2
(45) Date of Patent: May 31, 2005

(54) WAVE SEAL TO RESIST EXTRUSION DURING EQUALIZATION

(75) Inventor: Michael J. Bertoja, Pearland, TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 35 days.

(21) Appl. No.: 10/608,680

(22) Filed: Jun. 27, 2003

(65) Prior Publication Data

US 2004/0035583 A1 Feb. 26, 2004

Related U.S. Application Data

(60) Provisional application No. 60/401,446, filed on Aug. 6, 2002.

(51) Int. Cl.[7] ..... F16K 1/00; F16K 15/00

(52) U.S. Cl. ..... 251/325; 251/344; 166/316

(58) Field of Search ..... 251/325, 344; 166/316, 332.1, 334.3, 334.4; 277/449, 641, 642, 910

(56) References Cited

U.S. PATENT DOCUMENTS 3,183,009 A * 5/1965 Kunel ..... 277/565
6,056,292 A * 5/2000 Gerigk ..... 277/549
6,325,150 B1 * 12/2001 Rayssiguier ..... 166/334.4

* cited by examiner

*Primary Examiner*—Edward K. Look
*Assistant Examiner*—John K. Fristoe, Jr.
(74) *Attorney, Agent, or Firm*—Winstead Sechrest & Minich; Jaime A. Castaño; Brigitte Echols

(57) ABSTRACT

The present invention provides for dynamic sealing in a flow control device. In an embodiment, the flow control device comprises a closure sleeve adapted to slide over the tubing hole. The closure sleeve has a front edge having a wave-like surface. One or more seals are mounted downstream of the tubing hole. The one or more seals cooperate in a fluid-tight manner with the closure sleeve. A protective sleeve is mounted in alignment with the closure sleeve and proximate to the one or more seals. The protective sleeve has a top edge adapted for mating engagement with the wave-like surface of the front edge of the closure sleeve. A return mechanism is provided for automatically returning the protective sleeve to a covering position in which the protective sleeve covers the first seal when the first seal is not covered by the closure sleeve.

20 Claims, 3 Drawing Sheets

WAVE SEAL TO RESIST EXTRUSION DURING EQUALIZATION

CROSS-REFERENCE OF RELATED CASES

This application claims the benefit under 35 U.S.C. §119 to U.S. Provisional Patent Application Ser. No. 60/401,446, entitled WAVE SEAL TO RESIST EXTRUSION DURING EQUALIZATION, which was filed on Aug. 6, 2002.

FIELD OF THE INVENTION

The present invention relates to the dynamic sealing of pressure ports. More specifically, the present invention provides an apparatus adapted to prevent seal extrusion from occurring during the sealing and equalizing of pressure ports.

BACKGROUND OF THE INVENTION

Variable flow rate valves as well as two position on-off valves, such as slidably-mounted sleeve valves, play an essential part in optimized well management in oil wells of recent design. It is thus important for them to offer good reliability so that they can operate without maintenance for several years. Any maintenance on such valves is costly (removal and re-insertion of the production tubing), and it results being interrupted, which goes against the object that they are supposed to achieve (optimized well profitability).

One of the essential problems lies in the need to provide dynamic sealing gaskets on the production tubing, on either side of the holes formed therein, so that the valve is properly closed when the closure sleeve occupies the corresponding position.

Such dynamic sealing gaskets are inevitably made of a relatively soft material such as an elastomer or plastic. They are thus very fragile. In particular, they are very sensitive to wear, to abrasion, and to fatigue, and they are very poor at withstanding the flow of the petroleum fluid.

An additional problem appears when the valve is opened after being closed for a certain amount of time. There is then a pressure difference that is sometimes large between the dynamic pressure inside the production tubing and the higher or lower static pressure outside the tubing in the underground reservoir being tapped. On valve opening, the pressure equalization that tends to occur between the outside and the inside (or inside to outside) of the production tubing immediately imparts a high flow rate to the petroleum fluid. The high-rate flow sweeps the surface of the sealing gasket. If no particular precaution is taken, the gasket is then torn away or else it wears very rapidly.

In an attempt to remedy that drawback, it is common to limit the rate of the flow reaching the sealing gasket in question by interposing rings (generally made of metal or of polytetrafluoroethylene) between the gasket and the holes provided in the production tubing. However, such rings are not very effective, and they do not prevent the gasket from suffering accelerated damage as a result of the valve being opened.

SUMMARY OF THE INVENTION

In an embodiment, the present invention provides a flow control device for controlling the flow rate through tubing placed in an oil well. The tubing includes at least one hole therethrough.

The flow control device comprises a closure sleeve adapted to slide over the tubing hole (but can also slide inside the tubing hole). The closure sleeve has a front edge having a wave-like surface. One or more seals are mounted downstream of the tubing hole. The one or more seals cooperate in a fluid-tight manner with the closure sleeve. A protective sleeve is mounted in alignment with the closure sleeve and proximate to the one or more seals. The protective sleeve has a top edge adapted for mating engagement with the wave-like surface of the front edge of the closure sleeve. A return mechanism is provided for automatically returning the protective sleeve to a covering position in which the protective sleeve covers the first seal when the first seal is not covered by the closure sleeve.

BRIEF DESCRIPTION OF THE DRAWINGS

The invention will hereafter be described with reference to the accompanying drawings, wherein like reference numerals denote like elements, and.

DETAILED DESCRIPTION OF EXEMPLARY EMBODIMENTS

The present invention provides an improvement to U.S. Pat. No. 6,325,150 (the '150 patent), issued on Dec. 4, 2001, and incorporated herein by reference. More specifically, the present invention provides an improvement to the seal protector described in the '150 patent.

It should be understood that the flow control device upon which the seal protector of the '150 patent is located is exemplary and not limitative of the devices for which the seal protector can be used to advantage. Likewise, the present invention is not so limited. However, for purposes of illustration, the present invention will be described with reference to the flow control device of the '150 patent.

Figure 1:
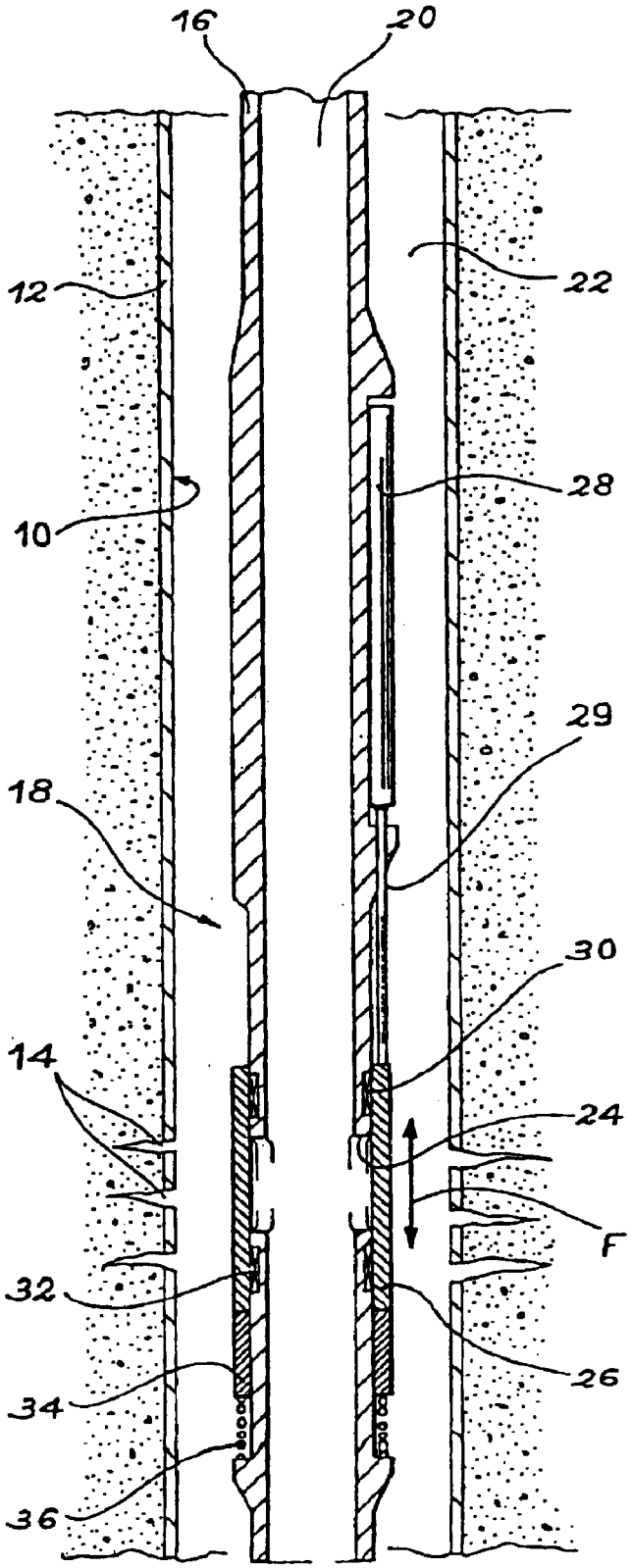
FIG. 1 (PRIOR ART)
FIG. 1 is a diagrammatic section view of a flow rate control device, as installed in the bottom of an oil well.

In FIG. 1 of the '150 patent, reference 10 designates an oil well in production, only a bottom region of which is shown. It should be noted that said bottom region may extend vertically, as shown, or horizontally, or on a slope, without going beyond the ambit of the invention. When the flow rate control device is placed in a horizontal or deviated region of a well, the expressions such as "downwards" and "upwards" used in the following description then mean respectively "away from the surface" and "towards the surface".

The walls of the oil well 10 are reinforced with casing 12. In the region of the well shown in FIG. 1, the casing 12 is perforated at 14 so as to cause the well to communicate with a natural deposit of petroleum fluid (not shown).

To enable the petroleum fluid to be conveyed to the surface, production tubing 16 is received coaxially in the well 10 over its entire depth. The production tubing 16 is made up of a plurality of tubing segments interconnected end-to-end. One of the segments, shown in FIG. 1, forms the body of the flow rate control device 18 of the invention. To simplify the description, the expression "production tubing" is used below to cover both the entire string of tubing, and also the specific segment of tubing.

Internally, the production tubing 16 defines a channel 20 via which the petroleum fluid rises towards the surface. The annular space 22 defined between the production tubing 16 and the casing 12 of the well 10 is closed, on either side of the flow rate control device 18 by annular sealing systems (not shown). Therefore, the petroleum fluid coming from the natural deposit (not shown) and admitted into the well via the perforations 14 can rise to the surface via the central channel 20 only by flowing through the flow rate control device 18.

Essentially, the flow rate control device 18 comprises at least one hole 24 formed in the production tubing 16, a closure sleeve 26, and drive means 28.

In practice, the flow rate control device 18 comprises a plurality of holes 24 distributed uniformly over the entire circumference of the production tubing 16. For example, each of the holes 24 has a shape that is elongate in the axial direction of the tubing. The holes 24 may however be of any number or of any shape without going beyond the ambit of the invention.

The closure sleeve 26 is mounted on the production tubing in a manner such that it can move parallel to the axis of the production tubing. More precisely, the closure sleeve 26 is suitable for moving between a "bottom" or "front" position shown in FIGS. 1 and 3, corresponding to the flow rate control device 18 being closed, and a "top" or "rear" position (FIG. 2), corresponding to the device 18 being fully open. Between these two extreme positions, the closure sleeve 26 may be moved continuously so as to vary the through section of the flow rate control device 18 and, as a result, so as to vary the flow rate of the petroleum fluid flowing through the device.

As shown, the closure sleeve 26 is mounted on the outside of the production tubing 16. However, the flow rate control device 18 of the invention is not limited to this mounting configuration, and it also covers configurations in which the closure sleeve 26 is placed inside the production tubing.

The drive means 28 comprise an actuator mounted outside the production tubing 16. The actuator, which is, for example, of the electromechanical type or of the hydraulic type, is suitable for moving the closure sleeve 26 continuously and in controlled manner parallel to the axis of the production tubing 16 as represented diagrammatically by arrow F in FIG. 1.

As mentioned above, installing the closure sleeve 26 outside the production tubing 16 makes it possible to simplify the device and to facilitate assembly thereof. The actuator can thus act on the closure sleeve without it being necessary for it to pass through the production tubing. In addition, the various parts can be assembled together by being fitted together axially, with the closure sleeve 26 being formed in one piece, and the corresponding segment of production tubing 16 being in one piece as well.

The drive means 28 act on the closure sleeve 26 via a link part 29 which may be of any shape without going beyond the ambit of the invention.

Figure 3:
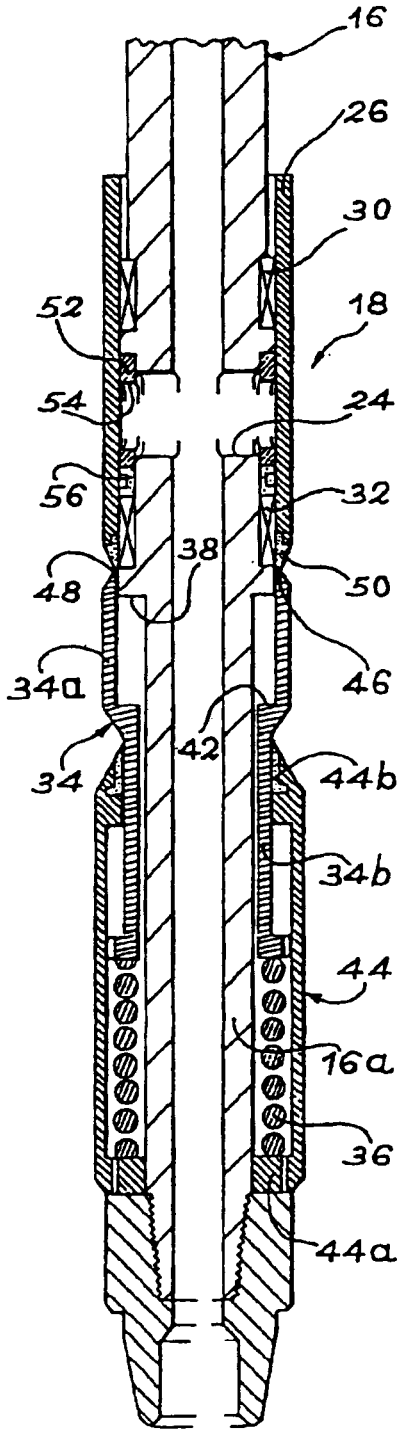
FIG. 3 (PRIOR ART)
FIG. 3 is a view comparable to FIG. 2, showing the device in its closed position.

Sealing means are provided on the production tubing 16 on either side of the holes 24 so as to co-operate in fluid-tight manner with the closure sleeve 26 when said sleeve is in its closed state, as shown in FIGS. 1 and 3. More precisely, sealing means 30 are mounted on the tubing 16 above the holes 24, and sealing means 32 are mounted on the tubing 16 below the holes 24.

As shown, the sealing means 30 and 32 are placed in annular grooves formed in the outside surface of the tubing 16 so as to co-operate in fluid- tight manner with the cylindrical inside surface of the closure sleeve 26.

The sealing means 30 and 32 are usually constituted by dynamic sealing gaskets that are annular in shape and that are made of a flexible material such as an elastomer.

In addition, below the closure sleeve 26 and in alignment therewith, the flow rate control device 18 includes a protective sleeve 34. Essentially, the function of the protective sleeve 34 is to provide continuity in covering the sealing means 32 when the closure sleeve 26 moves upwards, i.e. when the drive means 28 are actuated in the opening direction of the flow rate control device 18.

Finally, the flow rate control device 18 also includes return means 36 designed and organized in a manner such as to bring the protective sleeve 34 automatically into a position in which it covers the sealing means 32 when said sealing means do not co-operate with the closure sleeve 26.

The bottom portion of the flow rate control device 18 is described in more detail below with reference to FIGS. 2 and 3.

In its portion situated below the sealing means 32, the production tubing 16 has a portion 16*a* of relatively small diameter, defined at the top by a first shoulder 38 and at the bottom by a second shoulder 40. As shown in FIGS. 2 and 3, the second shoulder 40 may in particular be implemented in the form of the top face of another segment of the production tubing 16 or by some other separate part screwed to the bottom end of the portion 16*a* of relatively small diameter.

The protective sleeve 34 includes a top portion 24 of relatively large diameter, and a bottom portion 34*b* of relatively small diameter. The top portion 34*a* is organized to slide snugly on that portion of the production tubing 16 which carries the sealing means 32, while the bottom portion 34*b* is received with clearance around the portion 16*a* of relatively small diameter of the tubing 16. The top portion 34*a* and the bottom portion 34*b* of the protective sleeve 34 are separated from each other internally by a shoulder 42 suitable for coming into abutment against the first shoulder 38 which thus forms an abutment surface on the production tubing 16.

Figure 2:
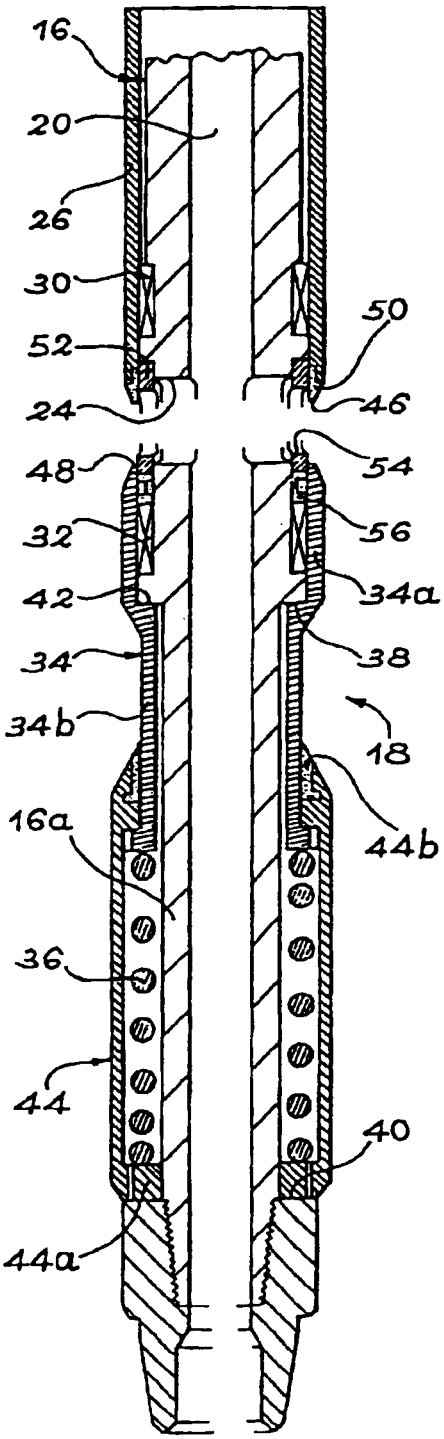
FIG. 2 (PRIOR ART)
FIG. 2 is a section view on a larger scale showing the bottom portion of the device shown in FIG. 1, in its fully-open position.

As shown in FIGS. 2 and 3, the return means 36 comprise resilient means constituted by a compression spring. This compression spring is disposed around the portion 16 of relatively small diameter of the production tubing 16. Its top end is in abutment against the bottom face of the protective sleeve 34, and its bottom end is in abutment against the second shoulder 40 formed on the tubing 16.

By means of this configuration, when the closure sleeve 26 takes up a fully open or partially open position, as shown in FIG. 2, the return means 36 hold the protective sleeve 34 in abutment against the abutment surface formed by the first shoulder 38. Under these conditions, the top portion 34 of relatively large diameter of the protective sleeve 34 covers the sealing means 32 snugly over their entire height. More precisely, the top end of the protective sleeve 34 is then flush with the bottoms of the holes 24 provided in the production tubing 16. Thus, the sealing means 32 are substantially not in contact with the fluid in the well, and they are maintained in a compressed state.

As also shown in FIGS. 2 and 3, the compression spring constituting the return means 36 is advantageously protected from the fluid in the well by a cover 44. This cover 44 is tubular in overall shape, and it is provided with a bottom flange 44 interposed between the second shoulder 40 and the bottom end of the compression spring. The cover 44 is thus prevented from moving relative to the production tubing 16.

The cover 44 is mounted on the bottom portion 34*b* of the protective sleeve 34 in a manner such that it co-operates therewith and with the compression spring 36 to form an assembly suitable for being mounted as a single unit on the production tubing 16.

As shown in FIGS. 2 and 3, the top portion 44*b* of the protective cover 44 is beveled and reinforced so as to form a scraper flush with the outside surface of the bottom portion 34*b* of the protective sleeve 34. The scraper formed in this way makes it possible to clean the surface when the protective sleeve 34 moves downwards against the return means 36.

In the flow rate control device 18 formed in this way, the closure sleeve 26 has no holes. The through section of the device, which section enables the flow rate to be controlled, is defined between the bottom or front edge 46 of the closure sleeve 26 and the holes 24 provided in the production tubing 16. More precisely, the further the front edge 46 moves upwards, the greater the through section of the device, and vice versa.

So long as the front edge 46 of the closure sleeve 26 remains in a partially open or fully open position as shown in FIG. 2, the protective sleeve 34 remains in abutment against the abutment surface formed by the shoulder 38.

When the closure sleeve 26 moves downwards to close the flow rate control device 18, the front edge 46 of the sleeve comes into abutment against the top or rear edge 48 of the protective sleeve 34, so as to push said protective sleeve progressively downwards against the return means 36 (FIG. 3). During this movement, the plane edges 46 and 48 are in abutment against each other over their entire circumference so that the sealing means 32 are constantly covered either by the protective sleeve 34, or in part by the protective sleeve 34 and in part by the closure sleeve 26 while said closure sleeve is descending, or else entirely by the closure sleeve 26 when the device is in the closed position, as shown in FIG. 3.

The present invention provides a wave seal device adapted to provide additional protection of the sealing means 32 during high equalization pressures. Because the interface between the closure sleeve 26 and the protective sleeve 34 is typically a flat plane that the sealing means 32 is aligned with, in some instances high equalization pressures (external to internal or internal to external) acting on the sealing means 32 can cause the sealing means 32 to extrude between the interface.

Figure 4:
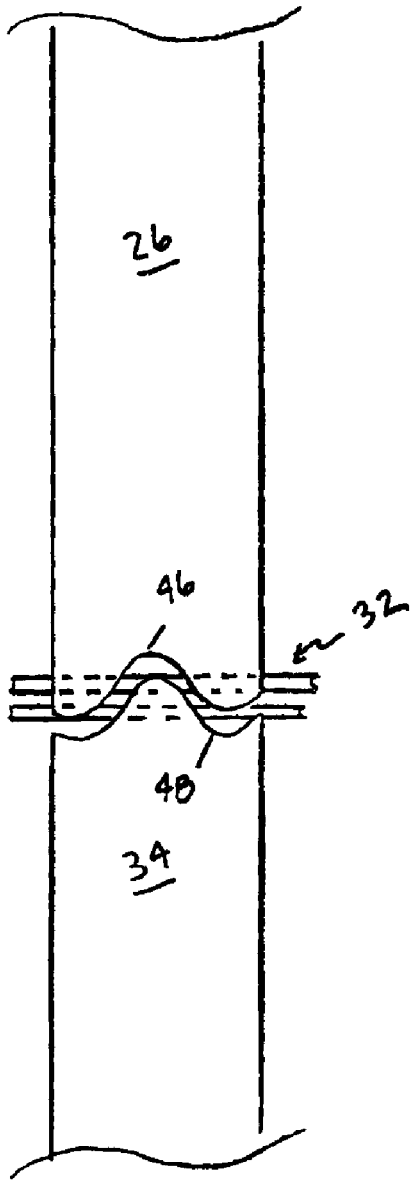
FIG. 4 is an illustration of an embodiment of the wave seal of the present invention.

To combat such seal extrusion, one embodiment of the wave seal of the present invention, illustrated in FIG. 4, provides a wavy interface between the closure sleeve 26 and the protective sleeve 34. As shown, the front edge 46 of the closure sleeve 26 and the top edge 48 of the protective sleeve 34 are formed with mating wavy surfaces. Accordingly, total alignment of the sealing means 32 with the interface between the sleeves 26, 34 is prevented. The wavy interface provides support for and contains the sealing means 32 even when larger gaps exist between the front edge 46 of the closure sleeve 26 and the top edge 48 of the protective sleeve 34 during equalization.

It should be understood that the wavy interface illustrated in FIG. 4 is exemplary and not intended to limit the scope of the wave seal of the present invention. There are a number of geometries and configurations that can be used to prevent total alignment of the sealing means 32 and the interface between the sleeves 26, 34.

Figure 5:
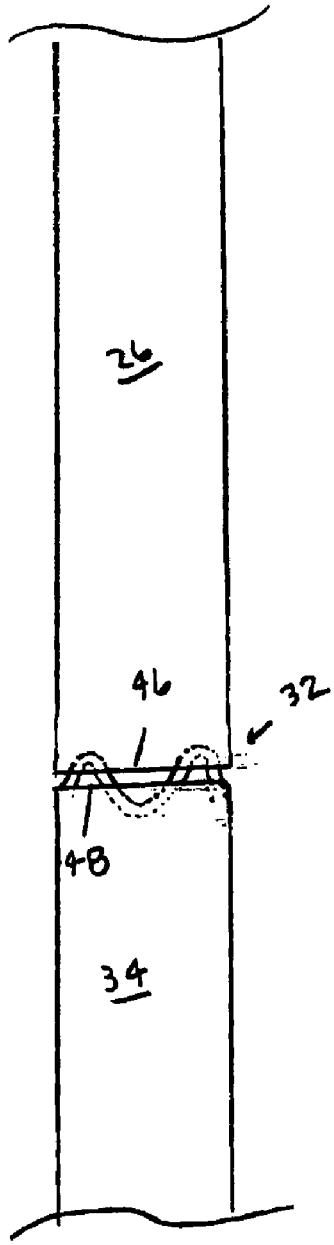
FIG. 5 is an illustration of another embodiment of the wave seal of the present invention.

Another embodiment of the wave seal of the present invention, illustrated in FIG. 5, provides a wavy sealing means 32*a* adapted to prevent seal extrusion. The wavy sealing means 32*a* prevents total alignment of the sealing means 32*a* with the interface between the closure sleeve 26 and the protective sleeve 34. Accordingly, when subjected to high equalization pressures, the sealing means 32*a* is prevented from extruding between the interface of the sleeves 26, 34. The extrusion is prevented even when the interface between the sleeves 26, 34 is a flat plane. Further, the extrusion is prevented even when larger gaps exist between the front edge 46 of the closure sleeve 26 and the top edge 48 of the protective sleeve 34 during equalization.

It should be understood that the wavy sealing means 32*a* shown in FIG. 5 is exemplary and not intended to limit the scope of the present invention. There are a number of geometries and configurations that can be used to prevent the sealing means 32*a* from total alignment with the interface between the sleeves 26, 34.

Naturally, the invention is not limited to the embodiments described above by way of example. The wave seal of the present invention can be used for any number of downhole devices requiring the dynamic sealing of pressure ports.

What is claimed is:

1. A flow control device for controlling the flow rate through tubing placed in an oil well, the tubing including at least one hole therethrough, the device comprising:

a closure sleeve adapted to slide over the tubing hole, the closure sleeve having a front edge having a wave-like surface;

one or more seals mounted downstream of the tubing hole, the one or more seals cooperating in a fluid-tight manner with the closure sleeve;

a protective sleeve mounted in alignment with the closure sleeve and proximate to the one or more seals, the protective sleeve having a top edge adapted for mating engagement with the wave-like surface of the front edge of the closure sleeve; and a return mechanism for automatically returning the protective sleeve to a covering position in which the protective sleeve covers the first seal when the first seal is not covered by the closure sleeve.

2. A device according to claim 1, wherein the return mechanism comprises a spring interposed between the tubing and the protective sleeve.

3. A device according to claim 2, wherein the closure sleeve is mounted on the outside of the tubing: and the spring is mounted on the outside of the tubing between the protective sleeve and a shoulder defined on the tubing.

4. A device according to claim 3, wherein a cover is placed around the spring.

5. A device according to claim 4, wherein the protective sleeve, the spring, and the cover from an assembly adapted to be mounted as a single unit on the tubing.

6. A device according to claim 1, wherein the closure sleeve is adapted to move between a closure position, in which the closure sleeve covers the one or more seals, and a controlled opening position, in which a front edge of the closure sleeve cooperates with the tubing hole to form a through hole of variable section.

7. A device according to claim 6, wherein: the protective sleeve occupies the covering position as long as the closure sleeve occupies the controlled opening position; the front edge of the closure sleeve is adapted to engage a top edge of the protective sleeve while the closure sleeve is moving towards its closure position; so that the one or more seals are always substantially covered by at least one of the closure sleeve and the protective sleeve.

8. A device according to claim 1, wherein the closure sleeve is mounted on an outer surface of the tubing.

9. A flow control device for controlling the flow rate through tubing placed in an oil well, the tubing including at least one hole therethrough, the device comprising:

a closure sleeve adapted to slide over the tubing hole;

one or more seals mounted downstream of the tubing hole, the one or more seals cooperating in a fluid-tight manner with the closure sleeve, the one or more seals having a wave-like geometry;

a protective sleeve mounted in alignment with the closure sleeve and proximate to the one or more seals; and a return mechanism for automatically returning the protective sleeve to a covering position in which the protective sleeve covers the one or more seals when the one or more seals are not covered by the closure sleeve;

wherein the wave-like geometry of the one or more seals prevents the total alignment of the one or more seals with an interface between the closure sleeve and the protective sleeve.

10. A device according to claim 9, wherein the return mechanism comprises a spring interposed between the tubing and the protective sleeve.

11. A device according to claim 10, wherein the closure sleeve is mounted on the outside of the tubing; and the spring is mounted on the outside of the tubing between the protective sleeve and a shoulder defined on the tubing.

12. A device according to claim 11, wherein a cover is placed around the spring.

13. A device according to claim 12, wherein the protective sleeve, the spring, and the cover form an assembly adapted to be mounted as a single unit on the tubing.

14. A device according to claim 9, wherein the closure sleeve is adapted to move between a closure position, in which the closure sleeve covers the one or more seals, and a controlled opening position, in which a front edge of the closure sleeve cooperates with the tubing hole to form a through hole of variable section.

15. A device according to claim 14, wherein: the protective sleeve occupies the covering position as long as the closure sleeve occupies the controlled opening position; the front edge of the closure sleeve is adapted to engage a top edge of the protective sleeve while the closure sleeve is moving towards its closure position, so that the one or more seals are always substantially covered by at least one of the closure sleeve and the protective sleeve.

16. A device according to claim 9, wherein the closure sleeve is mounted on an outer surface of the tubing.

17. A device according to claim 9, wherein:

the closure sleeve includes a front edge having a wave-like surface; and the protective sleeve includes a top edge adapted for mating engagement with the wave-like surface of the front edge of the closure sleeve.

18. A well completion, comprising;

a tubing including at least one hole therethrough;

a closure sleeve adapted to slide over the tubing hole, the closure sleeve having a wave-like front edge;

one or more seals mounted on the tubing downhole of the tubing hole, the one or more seals cooperating in a fluid-tight manner with the closure sleeve;

a protective sleeve mounted in alignment with the closure sleeve and proximate to the one or more seals, the protective sleeve having a top edge adapted for mating engagement with the front edge of the closure sleeve; and a return mechanism for automatically returning the protective sleeve to a covering position in which the protective sleeve covers the one or more seals when the one or more seals are not covered by the closure sleeve.

19. A well completion, comprising:

a tubing including at least one hole therethrough;

a closure sleeve adapted to slide over the tubing hole;

one or more seals mounted downstream of the tubing hole, the one or more seals cooperating in a fluid-tight manner with the closure sleeve, the one or more seals having a wave-like geometry;

a protective sleeve mounted in alignment with the closure sleeve and proximate to the one or more seals; and a return mechanism for automatically returning the protective sleeve to a covering position in which the protective sleeve covers the one or more seals when the one or more seals are not covered by the closure sleeve;

wherein the wave-like geometry seals prevents the total alignment of the one or more seals with an interface between the closure sleeve and the protective sleeve.

20. A device according to claim 19, wherein:

the closure sleeve includes a front edge having a wave-like surface; and the protective sleeve includes a top edge adapted for mating engagement with the wave-like surface of the front edge of the closure sleeve.

* * * * *